US006494296B2

(12) United States Patent
Lindegger et al.

(10) Patent No.: US 6,494,296 B2
(45) Date of Patent: Dec. 17, 2002

(54) DEVICE FOR SIGNALING MOVEMENT OF AN ELEVATOR CAR DURING THE EVACUATION OF ELEVATOR PASSENGERS

(75) Inventors: Urs Lindegger, Contone (CH); Andreas Dorsch, Ascona (CH); Max Brüllhardt, Dierikon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/843,350

(22) Filed: Apr. 26, 2001

(65) Prior Publication Data

US 2001/0035315 A1 Nov. 1, 2001

(30) Foreign Application Priority Data

Apr. 27, 2000 (EP) ..... 00810363

(51) Int. Cl.[7] ..... B66B 3/02
(52) U.S. Cl. ..... 187/393; 187/399
(58) Field of Search ..... 187/391, 393, 187/394, 397, 399, 287, 263

(56) References Cited

U.S. PATENT DOCUMENTS 4,898,263 A * 2/1990 Manske et al. ..... 187/247
5,313,026 A * 5/1994 Youla et al. ..... 187/134
5,740,888 A * 4/1998 Aulanko et al. ..... 187/336
5,890,565 A * 4/1999 Wang ..... 187/263
5,906,252 A * 5/1999 Wang ..... 187/263
5,971,109 A * 10/1999 Aulanko et al. ..... 187/263
6,269,910 B1 * 8/2001 Fargo et al. ..... 187/287
6,273,216 B1 * 8/2001 Kocher et al. ..... 187/254
6,302,240 B1 * 10/2001 Shih ..... 187/397

FOREIGN PATENT DOCUMENTS

| | | | | |
|---|---|---|---|---|
| DE | 296 15 921 | | 4/1997 | |
| DE | 197 54 034 | | 6/1999 | |
| JP | 04 189 284 | | 7/1992 | |
| JP | 05319710 | A * | 12/1993 | ..... B66B/1/46 |
| JP | 06100264 | A * | 4/1994 | ..... B66B/5/02 |

* cited by examiner

*Primary Examiner*—Jonathan Salata
(74) *Attorney, Agent, or Firm*—MacMillan, Sobanski & Todd, LLC

(57) ABSTRACT

An elevator drive has a traction sheave over which ropes are passed to move an elevator car and a counterweight up and down in an elevator hoistway. An elevator control in a control cabinet on a landing is connected with another elevator control in the hoistway and with the elevator car, and controls how the elevator car moves. The control cabinet also has a handle that is part of a Bowden cable acting on a brake of the elevator drive. The handle can be used to manually release the brake which permits the elevator car to move up or down depending on the difference in weight between the elevator car and the counterweight. The position of the elevator car in the hoistway is of significance to the elevator control. A tensioned toothed belt spanning the height of the hoistway is in contact with an encoder that detects the absolute position of the elevator car for the elevator control. For evacuation, a signal device is provided which allows evacuation of the car without looking into the elevator hoistway.

10 Claims, 3 Drawing Sheets

DEVICE FOR SIGNALING MOVEMENT OF AN ELEVATOR CAR DURING THE EVACUATION OF ELEVATOR PASSENGERS

BACKGROUND OF THE INVENTION

The present invention relates to a device for the evacuation of elevator passengers who are trapped in an elevator car stuck in an elevator hoistway, the elevator car being movable to the next floor by releasing the brake of the elevator drive.

The German utility model DE 296 15 921 U1 shows a device by which elevator passengers can be evacuated in an emergency. The device is intended for elevator installations with no machine room that have the drive unit arranged in the hoistway. If the elevator car becomes stuck in the hoistway, the brake is released manually and the elevator car is driven to the next floor, on which floor the elevator passengers can leave the elevator car safely. Actuation of the brake is by means of a Bowden cable from the landing of the floor on which the elevator control is also located. Moving the elevator car for the evacuation is done without a power supply to the elevator installation by using the difference in weight between the loaded elevator car and the counterweight. A battery is only provided to supply power to a signal device that indicates that the elevator car is at the evacuation floor.

A disadvantage of this known device is that the person operating the brake must observe the movement of the elevator car by seeing the movement of the overspeed governor rope, or by seeing the movement of the suspension ropes. To monitor the speed of the elevator car by means of the moving ropes requires great experience and attention, and cannot be expected of inexperienced persons.

SUMMARY OF THE INVENTION

The present invention concerns an apparatus for avoiding the disadvantages of the known device, and creating a device by means of which persons trapped in an elevator car can be evacuated safely.

The advantages achieved by the present invention include that the evacuation of trapped elevator passengers can also be carried out by inexperienced persons. The signal device according to the present invention monitors the movement of the elevator car, and indicates to the person performing the evacuation both normal and abnormal operating statuses visually and acoustically. With the signal device according to the present invention, evacuation is simple and safe even for inexperienced persons. There is no need for an observation window arranged in the hoistway wall to make it possible to see into the hoistway and, in particular, to see the elevator drive and the ropes.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
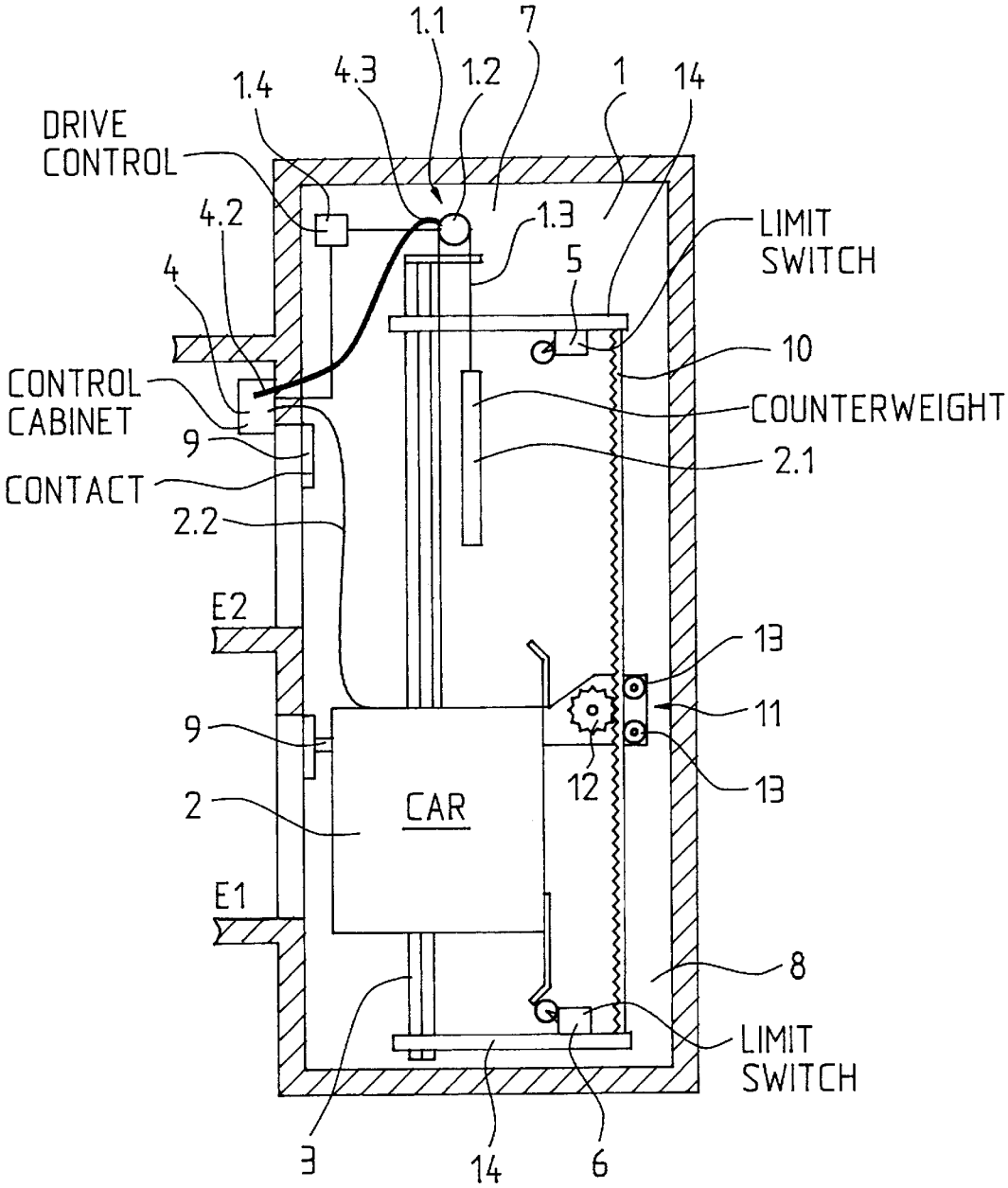
FIG. 1 is a cross-sectional schematic view of an elevator installation having an evacuation device in accordance with the present invention.

FIG. 1 shows an elevator installation without a machine room. The evacuation device according to the present invention can also be used for elevator installations with a machine room. An elevator drive 1.1 with traction sheave 1.2, over which ropes 1.3 are passed, moves an elevator car 2 and a counterweight 2.1 up and down in an elevator hoistway 1. The elevator drive 1.1 is supplied from an elevator drive control 1.4 located in the hoistway 1. The elevator car 2 can be moved along guiderails 3 that extend vertically in the hoistway 1. An elevator car control 4.1 (FIG. 2) is arranged on a landing E2 in a control cabinet 4 and is connected via a traveling cable 2.2 to the elevator car 2 to control how the elevator car moves, and to ensure the safety of the elevator operation. Also arranged in the control cabinet 4 is a handle 4.2 which is part of a Bowden cable 4.3 acting on a brake 4.4 (FIG. 2) of the elevator drive 1.1. The handle 4.2 can be used to release the brake 4.4 manually. With the brake 4.4 released, the elevator car 2 moves up or down depending on the difference in weight between the elevator car and the counterweight 2.1. The elevator car 2 serves a floor E1 as well as the floor E2. In the example shown, the elevator installation is illustrated with two floors, but there can also be more. The safety circuit of the elevator installation consists of a series connection of contacts of the hoistway doors (not shown) and of an upper and lower limit switches 5 and 6 respectively in the elevator hoistway 1. The upper limit switch 5 prevents the elevator car 2 from traveling into a hoistway headroom area 7, while the lower limit switch 6 prevents the elevator car from traveling into a hoistway pit area 8. When the elevator car 2 levels to one of the landings E1, E2, a door zone contact 9 is actuated which bridges the safety contact of the hoistway door of the landing, as a result of which the car door and the hoistway door are opened in advance, without the safety circuit being broken.

For the elevator control 4.1 the position of the elevator car 2 in the elevator hoistway 1 is of significance. For this purpose a device for the generation of the hoistway information is necessary. In the present example the device includes, for example, a toothed belt 10 and an encoder 11 in contact with the toothed belt which registers the absolute position of the elevator car 2. The encoder 11 arranged on the elevator car 2 has a toothed pulley 12 that can be driven by a toothed surface the toothed belt 10 when the elevator car travels in the elevator hoistway 1. Idler rollers 13 contact a surface opposite the toothed surface to guarantee secure engagement of the toothed pulley 12 in the teeth of the toothed belt 10. The toothed belt 10 is attached at each end to a crosspiece 14 secured in the hoistway 1.

Figure 2:
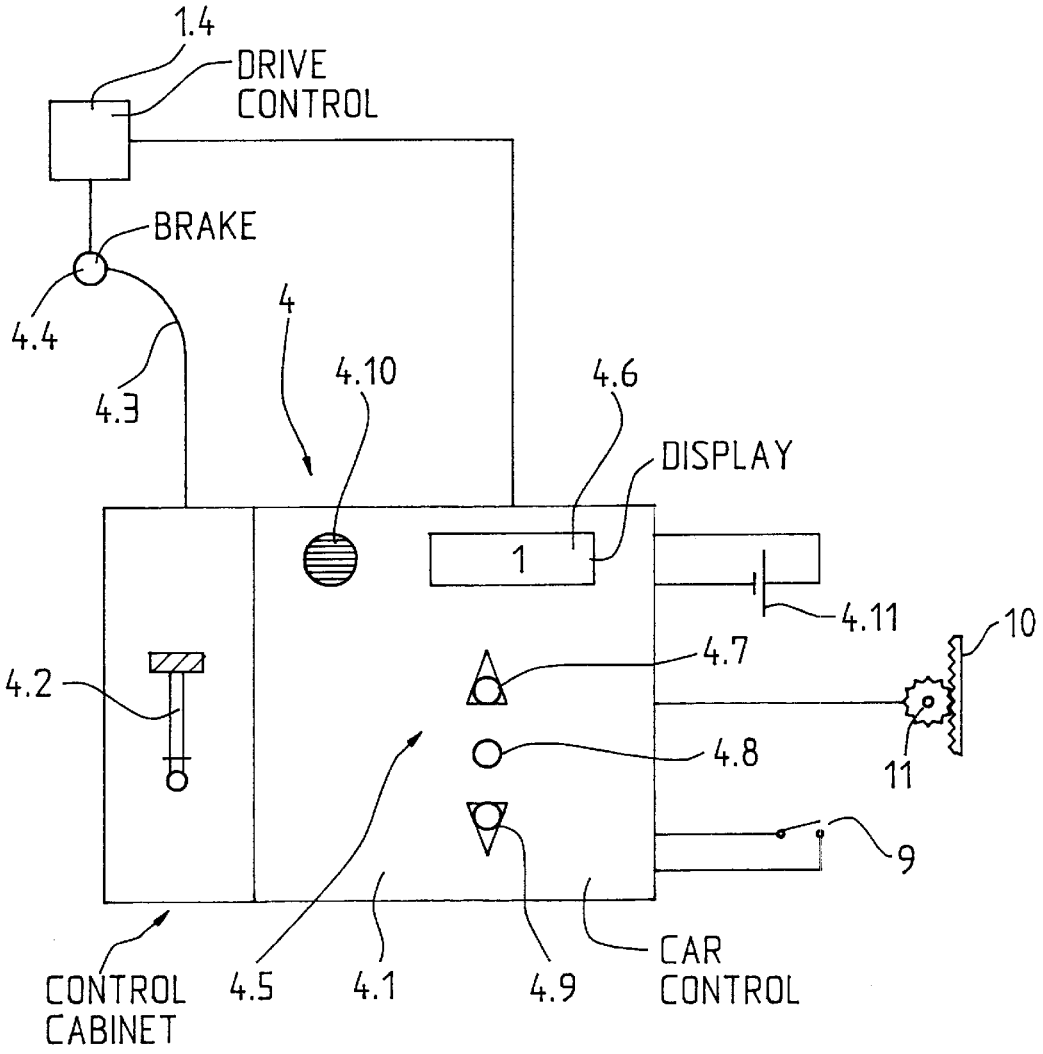
FIG. 2 is a schematic view of the evacuation device shown in FIG. 1.

FIG. 2 shows details of the control cabinet 4 with the handle 4.2 and the elevator car control 4.1, the elevator car control including a signal device 4.5. The signal device 4.5 includes the following elements: a display 4.6 that shows the floor at which the elevator car 2 is located; an upward-pointing arrow with a light-emitting diode 4.7 that indicates movement of the elevator car 2 upward; a light-emitting diode 4.8 that lights up when the elevator car 2 enters the door zone area as detected by the door zone contact 9; a downward-pointing arrow with a light-emitting diode 4.9 that indicates movement of the elevator car 2 downward; and an acoustic emitter 4.10, for example a buzzer, that generates a warning signal if the elevator car 2 overspeeds. As a variant, the light-emitting diode 4.8 can indicate that the elevator car 2 is level with the landing E1 or E2. Should the power supply voltage fail, those parts of the elevator control 4.1 that are necessary for evacuation, the encoder 11, the signal device 4.5, and the door zone contact 9, are supplied with power from a battery 4.11. In normal operation, the elevator car control 4.1 periodically draws power from the battery 4.11 and measures the battery voltage, and issues a fault message if the values are not as they should be.

For evacuation, the brake 4.4 is released by means of the handle 4.2. Depending on the difference in weight between the loaded elevator car 2 and the counterweight 2.1, the elevator car and the counterweight begin to move. For example, if there is one passenger in the elevator car 2, the elevator car moves upward. The position of the elevator car 2 is detected by means of the encoder 11 and converted into a speed signal by the elevator control 4.1. If the speed of the elevator car 2 does not exceed, for example, 25% of the nominal speed, the light-emitting diode 4.7 with upwardly-pointing arrow is constantly lit up. If the speed of the elevator car 2 exceeds the speed limit of, for example, 25% the light-emitting diode 4.7 starts to flash and the buzzer 4.10 generates a warning signal. In this case, the person performing the evacuation will brake the elevator car 2 by means of the handle 4.2, Bowden cable 4.3, and brake 4.4 until the warning signal no longer sounds and the light-emitting diode 4.7 lights up constantly.

The elevator car control 4.1 uses the position information from the encoder 11 to calculate the direction and speed of the elevator car 2. The elevator car control 4.1 knows the nominal speed of the elevator car 2 and the speed limit of, for example, 25% and sends to the elements of the signal device 4.5 a signal that depends on the current, calculated speed, and direction.

Figure 3:
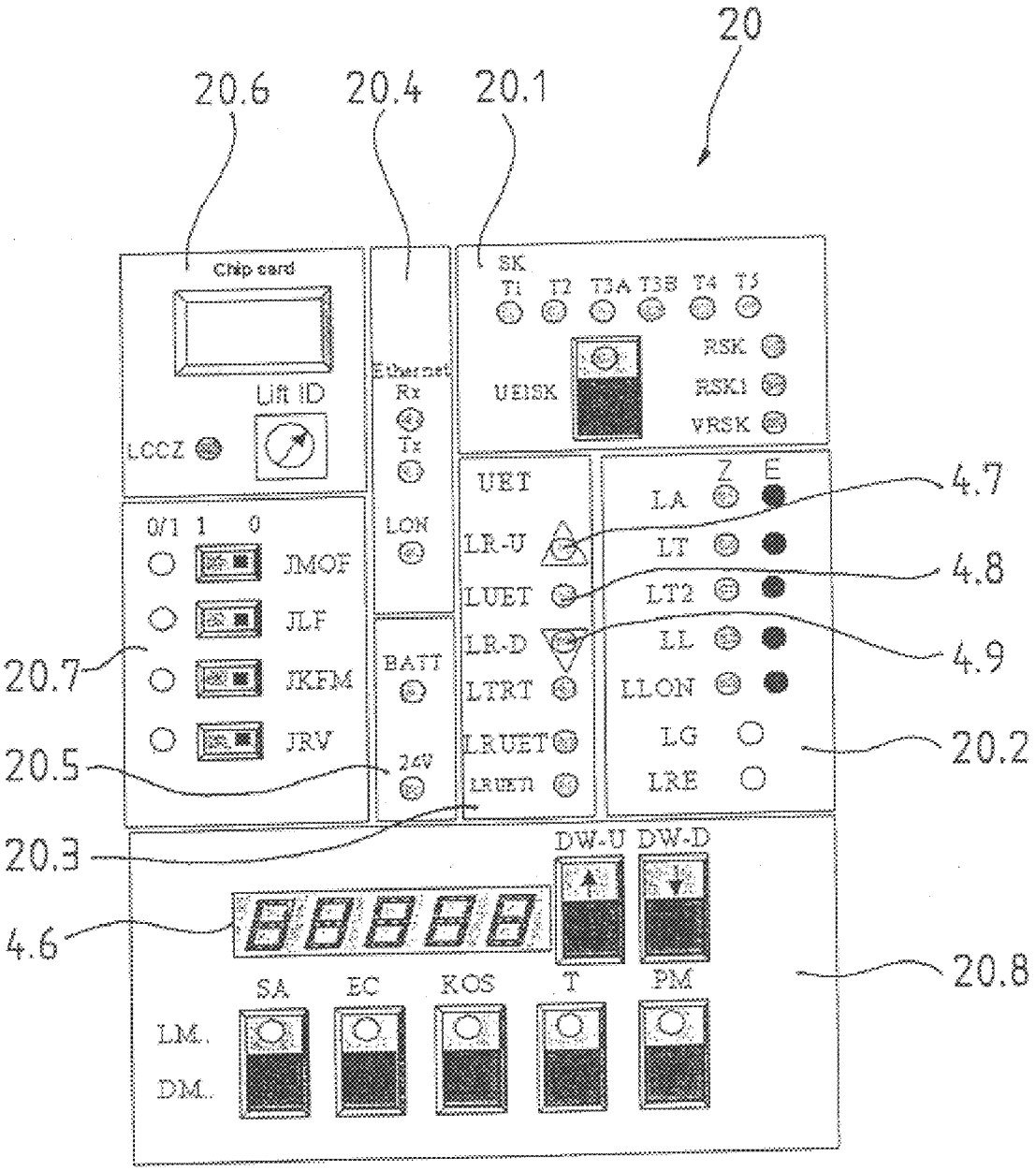
FIG. 3 is an elevation view of a control panel of the elevator car for commissioning, maintenance, and evacuation use of the evacuation device according to the present invention.

The signal device 4.5 is part of a control panel 20, shown in FIG. 3, of the elevator that serves installation and maintenance personnel as an interface for commissioning, maintenance, and evacuation. The display and control elements of the control panel 20 are arranged in groups. A first group 20.1 contains display elements and buttons of the safety circuit with test points and status displays of the safety circuit relays. A second group 20.2 contains status displays of the subsystems as, for example, the drive, doors, etc. A third group 20.3 contains status displays of the elevator car 2. The light-emitting diodes 4.7, 4.8 and 4.9 of the signal device 4.5 shown in FIG. 2 are contained in this group. A fourth group 20.4 contains status displays of the communications system. A fifth group 20.5 contains status displays of the power supply voltage and the battery 4.11. A sixth group 20.6 contains an interface for a chip card with the commission-dependent data of the elevator installation, and a step switch for identification of the elevator. A seventh group 20.7 contains switches for defining certain commissioning and/or diagnostic functions. Arranged in an eighth group 20.8 are the display 4.6 and elements for entering commands. Switches in a bottom row of the eighth group 20.8 are for basic functions such as, for example, position, car call, stopping floor, tests, or parameters. Switches in the upper row of the eighth group can be used to change specified values in the + or − direction. Not visible on the control panel 20 is the buzzer 4.10 of the signal device 4.5.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An evacuation device for signaling car movement during evacuation of elevator passengers who are trapped in an elevator car stuck in an elevator hoistway, the elevator car being movable to the next floor by releasing a brake of an elevator drive, comprising:

a signal device having means for indicating to a person performing an evacuation from an elevator car an operating status of the elevator car in response to movement and position information;

a means for detecting movement and position of the elevator car in a hoistway and providing said movement and position information to said means for indicating; and an elevator car control connected to said means for indicating and said means for detecting, said elevator car control being responsive to said movement and position information from said means for detecting to determine an evacuation speed and an evacuation direction of the elevator car and cause said means for indicating to indicate the operating status of the elevator car.

2. The evacuation device according to claim 1 wherein said signal device means for indicating includes a visual floor display indicating to the person a floor at which the elevator car is located.

3. The evacuation device according to claim 1 wherein said signal device means for indicating includes a visual display indicating to the person an evacuation speed and an evacuation direction of the elevator car.

4. The evacuation device according to claim 1 wherein said signal device means for indicating includes a visual display and an acoustic signal indicating to the person an overspeed condition of the elevator car during evacuation.

5. The evacuation device according to claim 1 wherein said means for detecting includes an encoder arranged on the elevator car for detecting a position of the elevator car in the hoistway and generating said movement and position information.

6. The evacuation device according to claim 1 wherein said elevator car control is responsive to said movement and position information to determine when a speed limit depending on a nominal speed of the elevator car is exceeded resulting in an overspeed condition, whereupon said elevator car control causes said signal device to generate visual and acoustic indications of the overspeed condition.

7. An evacuation device for signaling car movement during evacuation of elevator passengers who are trapped in an elevator car stuck in an elevator hoistway, the elevator car being movable to the next floor by releasing a brake of an elevator drive, comprising:

an elevator car control for controlling movement of an elevator car;

a signal device connected to said elevator car control and having means for indicating to a person performing an evacuation from the elevator car an operating status of the elevator car in response to movement and position information; and a means for detecting movement and position of the elevator car in a hoistway and being connected to said elevator car control for providing said movement and position information to said means for indicating, said means for detecting including an encoder arranged on the elevator car for detecting a position of the elevator car in the hoistway and generating said movement and position information, said encoder engaging a toothed belt extending along the hoistway.

8. The evacuation device according to claim 7 wherein said signal device means for indicating includes a visual floor display indicating to the person a floor at which the elevator car is located; a visual display indicating to the person an evacuation speed and an evacuation direction of the elevator car, and a visual display and an acoustic signal indicating to the person an overspeed condition of the elevator car during evacuation.

9. An evacuation device for signaling car movement during evacuation of elevator passengers who are trapped in an elevator car stuck in an elevator hoistway, the elevator car being movable to the next floor by releasing a brake of an elevator drive, comprising:

an elevator car control for controlling movement of an elevator car;

a signal device connected to said elevator car control and having means for indicating to a person performing an evacuation from the elevator car an operating status of the elevator car in response to movement and position information;

a means for detecting movement and position of the elevator car in a hoistway and being connected to said elevator car control for providing said movement and position information to said means for indicating; and a manual brake release mounted at said elevator car control for connection to the brake of the elevator drive.

10. The evacuation device according to claim 9 wherein said manual brake release includes a handle connected to a Bowden cable for connection to the brake of the elevator drive.

* * * * *